US010335620B2

(12) United States Patent
Burkett et al.

(10) Patent No.: US 10,335,620 B2
(45) Date of Patent: Jul. 2, 2019

(54) METHODS OF MAKING MANUFACTURED HOUSING COMPONENTS AND MANUFACTURED HOMES

(71) Applicant: ScotBilt Homes, Inc., Waycross, GA (US)

(72) Inventors: Ronald Anthony Burkett, Denton, GA (US); Gregory Keith Scott, Waycross, GA (US)

(73) Assignee: ScotBilt Homes, Inc., Waycross, GA (US)

( * ) Notice: Subject to any disclaimer, the term of this patent is extended or adjusted under 35 U.S.C. 154(b) by 0 days.

(21) Appl. No.: 15/643,615

(22) Filed: Jul. 7, 2017

(65) Prior Publication Data

US 2018/0161611 A1 Jun. 14, 2018

Related U.S. Application Data

(60) Provisional application No. 62/432,885, filed on Dec. 12, 2016.

(51) Int. Cl.

| | |
|---|---|
| ***E04B 2/74*** | (2006.01) |
| ***A62C 35/58*** | (2006.01) |
| ***E04B 2/70*** | (2006.01) |
| ***E04F 17/08*** | (2006.01) |
| *E04B 1/343* | (2006.01) |

(52) U.S. Cl.

CPC ..... *A62C 35/58* (2013.01); *E04B 2/70* (2013.01); *E04B 2/7411* (2013.01); *E04F 17/08* (2013.01); *E04B 1/34336* (2013.01)

(58) Field of Classification Search

CPC ..... A62C 35/58; A62C 35/68; E04B 1/34336; E04B 2/7411; E04B 2001/949; E04B 1/941; E04B 1/94; E04F 17/08; E04F 19/022; E04F 19/0436

See application file for complete search history.

(56) References Cited

U.S. PATENT DOCUMENTS

| | | | | |
|---|---|---|---|---|
| 860,884 | A | 7/1907 | Priddle | |
| 2,706,006 | A * | 4/1955 | Valente | A62C 35/58 169/16 |
| 2,809,074 | A * | 10/1957 | McDonald | A62C 3/00 169/16 |
| D188,180 | S | 6/1960 | Grayboft | |
| 3,011,601 | A | 12/1961 | Bernard | |
| 3,077,008 | A | 2/1963 | De Flon | |
| 3,195,698 | A | 7/1965 | Codrea | |
| 3,303,581 | A | 2/1967 | Levinson | |
| 3,350,826 | A | 11/1967 | Hughes | |
| 3,464,172 | A * | 9/1969 | McGee, Jr. | E04B 1/945 169/16 |
| 3,514,912 | A | 6/1970 | Smith | |
| 3,680,271 | A | 8/1972 | Satchell | |

(Continued)

OTHER PUBLICATIONS https://www.youtube.com/watch?v=RD oH8vallU Posted May 31, 2013.

http://www.free-ed.net/free-ed/Resources/Trades/carpentry/Building01/default.asp?iNum=0803, Mar. 19, 2018, pp. 1-22.

*Primary Examiner* — Adriana Figueroa
*Assistant Examiner* — Jessie T Fonseca
(74) *Attorney, Agent, or Firm* — Withers & Keys, LLC

(57) ABSTRACT

Methods of making manufactured housing components and manufactured homes are disclosed. Manufactured housing components and manufactured homes are also disclosed.

18 Claims, 17 Drawing Sheets

(56) References Cited

U.S. PATENT DOCUMENTS

| | | | | | |
|---|---|---|---|---|---|
| 3,831,681 | A * | 8/1974 | Livingston | A62C 35/58 | 169/16 |
| 4,012,875 | A * | 3/1977 | Hirsch | A62C 35/58 | 239/209 |
| 4,037,379 | A | 7/1977 | Ozanne | | |
| 4,091,876 | A * | 5/1978 | Valdatta | A62C 3/07 | 169/11 |
| 4,219,979 | A | 9/1980 | Wiles | | |
| 4,443,983 | A | 4/1984 | Karistrom | | |
| 4,813,193 | A | 3/1989 | Altizer | | |
| 4,834,186 | A * | 5/1989 | Ballard | A62C 37/09 | 169/16 |
| 4,986,043 | A | 1/1991 | Love | | |
| 5,177,917 | A | 1/1993 | de Castillo Von Haucke | | |
| 5,203,132 | A | 4/1993 | Smolik | | |
| 5,327,976 | A * | 7/1994 | Hattori | A62C 35/58 | 169/16 |
| 5,526,617 | A * | 6/1996 | Grice | E03B 7/09 | 52/106 |
| 5,765,330 | A | 6/1998 | Richard | | |
| 5,916,077 | A | 6/1999 | Tang | | |
| 5,937,607 | A | 8/1999 | Li | | |
| 6,003,280 | A * | 12/1999 | Wells | E04B 1/08 | 52/653.1 |
| 6,240,695 | B1 | 6/2001 | Karalic | | |
| 6,389,767 | B1 | 5/2002 | Lucey | | |
| 6,481,172 | B1 | 11/2002 | Porter | | |
| 6,931,804 | B2 | 8/2005 | Trarup | | |
| 7,506,479 | B2 | 3/2009 | Pryor | | |
| 7,690,167 | B2 | 4/2010 | Antonic | | |
| 7,694,483 | B1 | 4/2010 | Tucker | | |
| 7,699,117 | B2 * | 4/2010 | Johnston | A62C 35/68 | 169/16 |
| 8,671,636 | B2 | 3/2014 | Bruner | | |
| D758,614 | S | 6/2016 | Lundell | | |
| D781,446 | S | 3/2017 | Lundell | | |
| D781,447 | S | 3/2017 | Lundell | | |
| D809,160 | S | 1/2018 | Zuellig | | |
| D811,618 | S | 2/2018 | Zuellig | | |
| 2001/0002529 | A1 | 6/2001 | Commins | | |
| 2003/0230042 | A1 | 12/2003 | Rhodebeck | | |
| 2007/0051052 | A1 | 3/2007 | Toledo | | |
| 2007/0130866 | A1 | 6/2007 | Lott | | |
| 2008/0016811 | A1 * | 1/2008 | Johnston | E04F 19/0436 | 52/506.08 |
| 2014/0053486 | A1 | 2/2014 | Grisolia | | |
| 2014/0115976 | A1 | 5/2014 | Lippert | | |

* cited by examiner

METHODS OF MAKING MANUFACTURED HOUSING COMPONENTS AND MANUFACTURED HOMES

CROSS-REFERENCE TO RELATED APPLICATIONS

This patent application claims the benefit of priority to U.S. Provisional Patent Application Ser. No. 62/432,885 filed on Dec. 12, 2016 and entitled "METHODS OF MAKING MANUFACTURED HOUSING COMPONENTS AND MANUFACTURED HOMES", the subject matter of which is hereby incorporated by reference in its entirety.

FIELD OF THE INVENTION

The present invention is directed to methods of making manufactured housing components and manufactured homes. The present invention is further directed to manufactured housing components and manufactured homes.

BACKGROUND

Efforts continue to further develop methods of making manufactured housing components and manufactured homes.

SUMMARY

The present invention addresses some of the efforts discussed above by the discovery of new methods of making manufactured housing components and manufactured homes.

Accordingly, the present invention is directed to a method of making manufactured housing components. In one exemplary embodiment, the method of making a manufactured housing component for a manufactured home, the method comprising: forming a preassembled fire prevention pipe structure having an overall pipe structure length $L_{ps}$, an overall pipe structure width $W_{ps}$, and an overall pipe structure height $H_{ps}$, the overall pipe structure length $L_{ps}$ being at least 50% of an overall home length $L_h$ of the manufactured home, wherein the preassembled fire prevention pipe structure is insertable into a manufactured home, as a single piece, so as to provide a fire prevention pipe structure for the manufactured home.

The present invention is further directed to methods of making a manufactured home. In one exemplary embodiment, the method of making a manufactured home comprises: forming a preassembled fire prevention pipe structure having an overall pipe structure length $L_{ps}$, an overall pipe structure width $W_{ps}$, and an overall pipe structure height $H_{ps}$, the overall pipe structure length $L_{ps}$ being at least 50% of an overall home length $L_h$ of the manufactured home 100; and after the forming step, incorporating the preassembled fire prevention pipe structure into the manufactured home, as a single piece, so as to provide a fire prevention pipe structure for the manufactured home.

The present invention further relates to manufactured housing components suitable for use in manufactured homes. In one exemplary embodiment, the manufactured housing component comprises a preassembled fire prevention pipe structure for a manufactured home, the preassembled fire prevention pipe structure comprising: multiple pipe segments and multiple pipe couplings connected to one another so as to have an overall pipe structure length, an overall pipe structure width, and an overall pipe structure height, the overall pipe structure length being at least 50% of an overall home length of the manufactured home, wherein the preassembled fire prevention pipe structure is insertable into a manufactured home, as a single piece, so as to provide a fire prevention pipe structure for the manufactured home.

The present invention further relates to manufactured homes. In one exemplary embodiment, the manufactured home has an overall home length and an overall home width, and the manufactured home comprises: one or more walls extending in the overall home width, at least one of the one or more walls extending in the overall home width comprises a wall notch within an upper surface of one or more walls extending in an overall home width of the manufactured home.

These and other features and advantages of the present invention will become apparent after a review of the following detailed description of the disclosed embodiments and the appended claims.

DETAILED DESCRIPTION

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations, further modifications, and such further applications of the principles of the present invention discussed are contemplated as would normally occur to one ordinarily skilled in the art to which the invention pertains.

The present invention is directed to methods of making manufactured housing components for manufactured homes. The present invention is further directed to methods of making manufactured homes. The present invention is even further directed to manufactured housing components suitable for use in manufactured homes. The present invention is even further directed to manufactured homes.

The methods of making manufactured housing components and manufactured homes, manufactured housing components and manufactured homes of the present invention are further described in the following embodiments.

Other Embodiments

Methods of Making Manufactured Housing Components and Manufactured Homes

Figure 1:
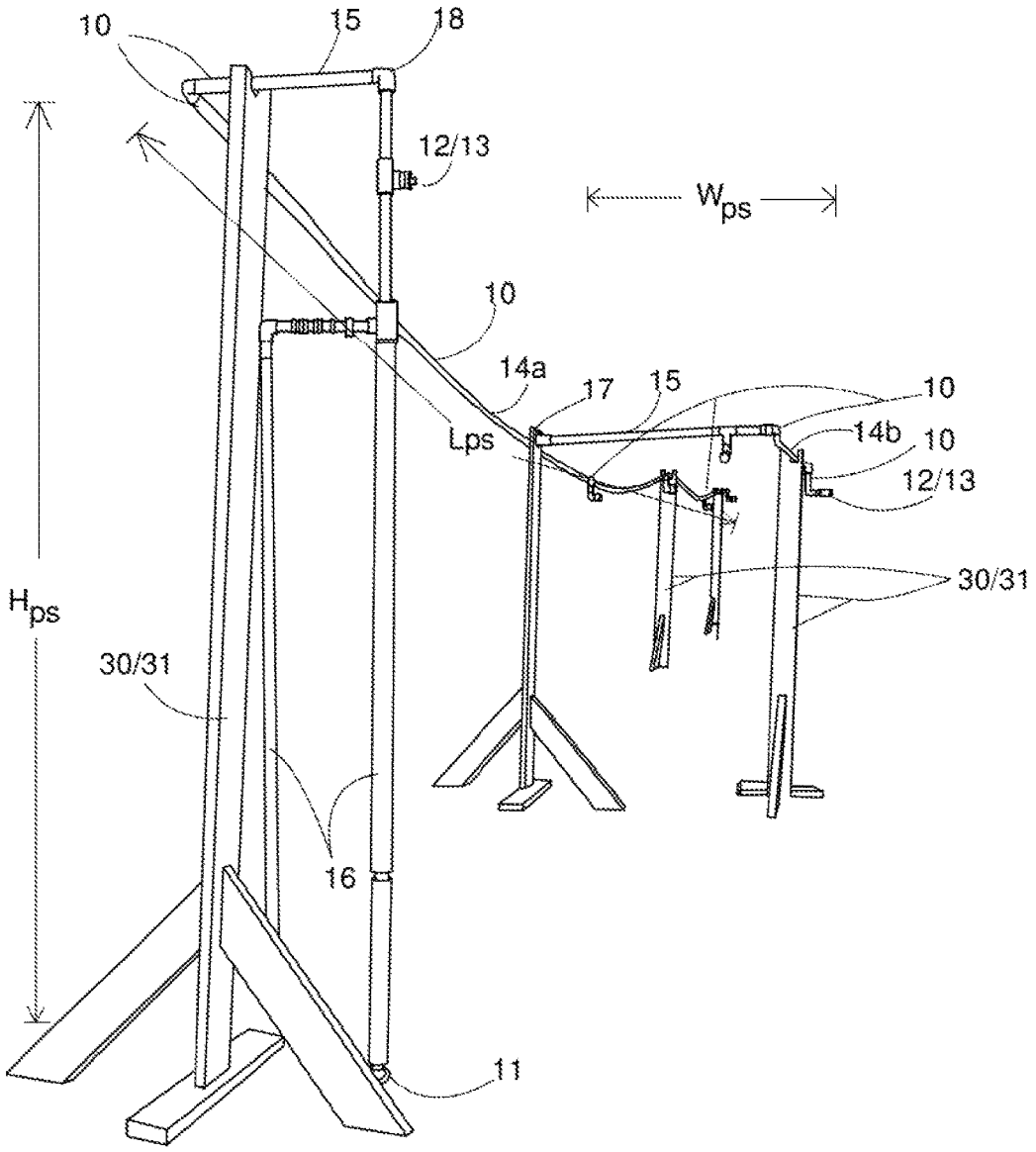
FIG. 1 depicts a perspective view of an exemplary preassembled fire prevention pipe structure of the present invention, which is suitable for use in a manufactured home.
Figure 2:
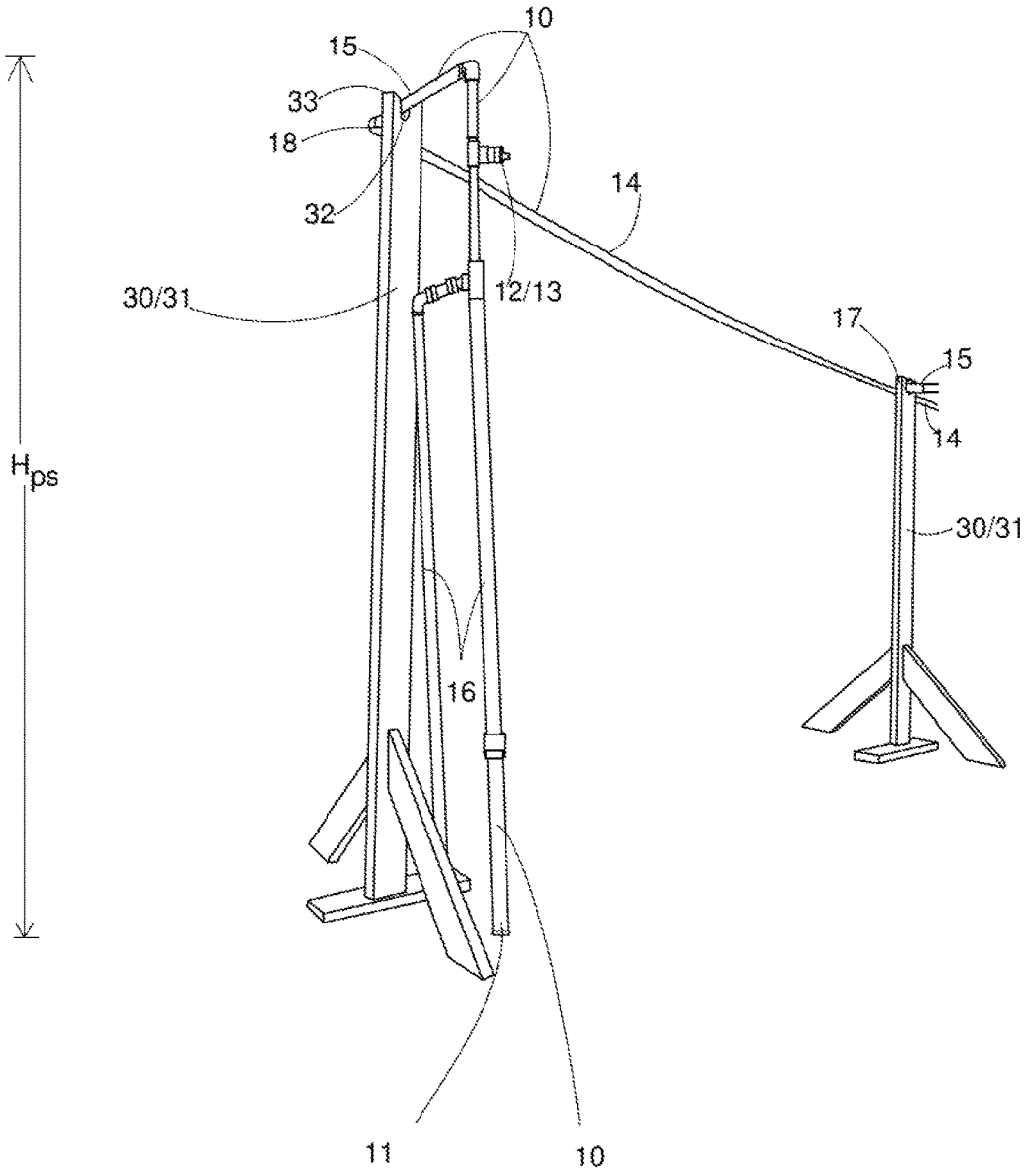
FIG. 2 depicts a perspective view of a portion of the exemplary preassembled fire prevention pipe structure of the present invention shown in FIG. 1.
Figure 3:
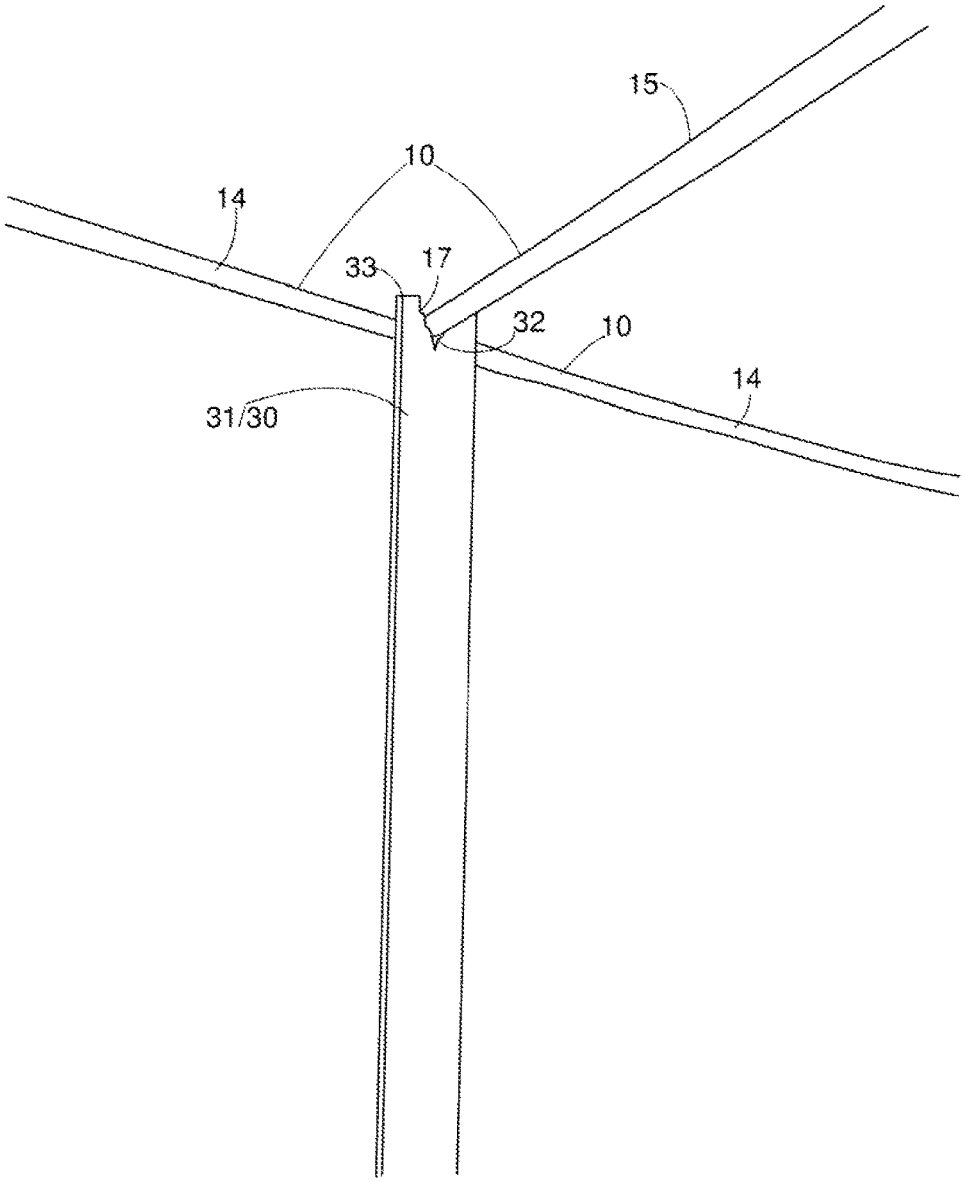
FIG. 3 depicts a perspective view of another portion of the exemplary preassembled fire prevention pipe structure of the present invention shown in FIG. 1.
Figure 4:
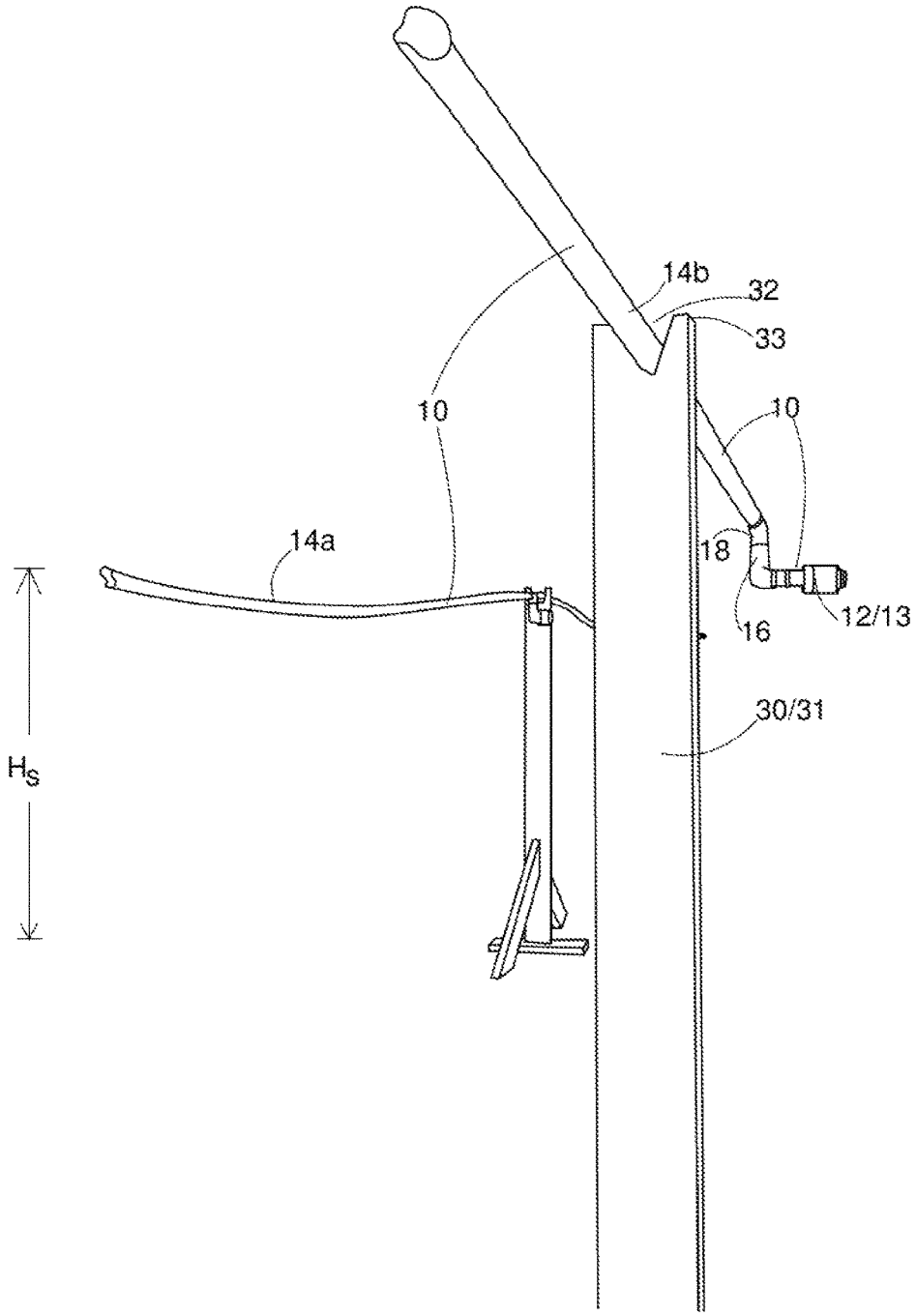
FIG. 4 depicts a perspective view of another portion of the exemplary preassembled fire prevention pipe structure of the present invention shown in FIG. 1.
Figure 8:
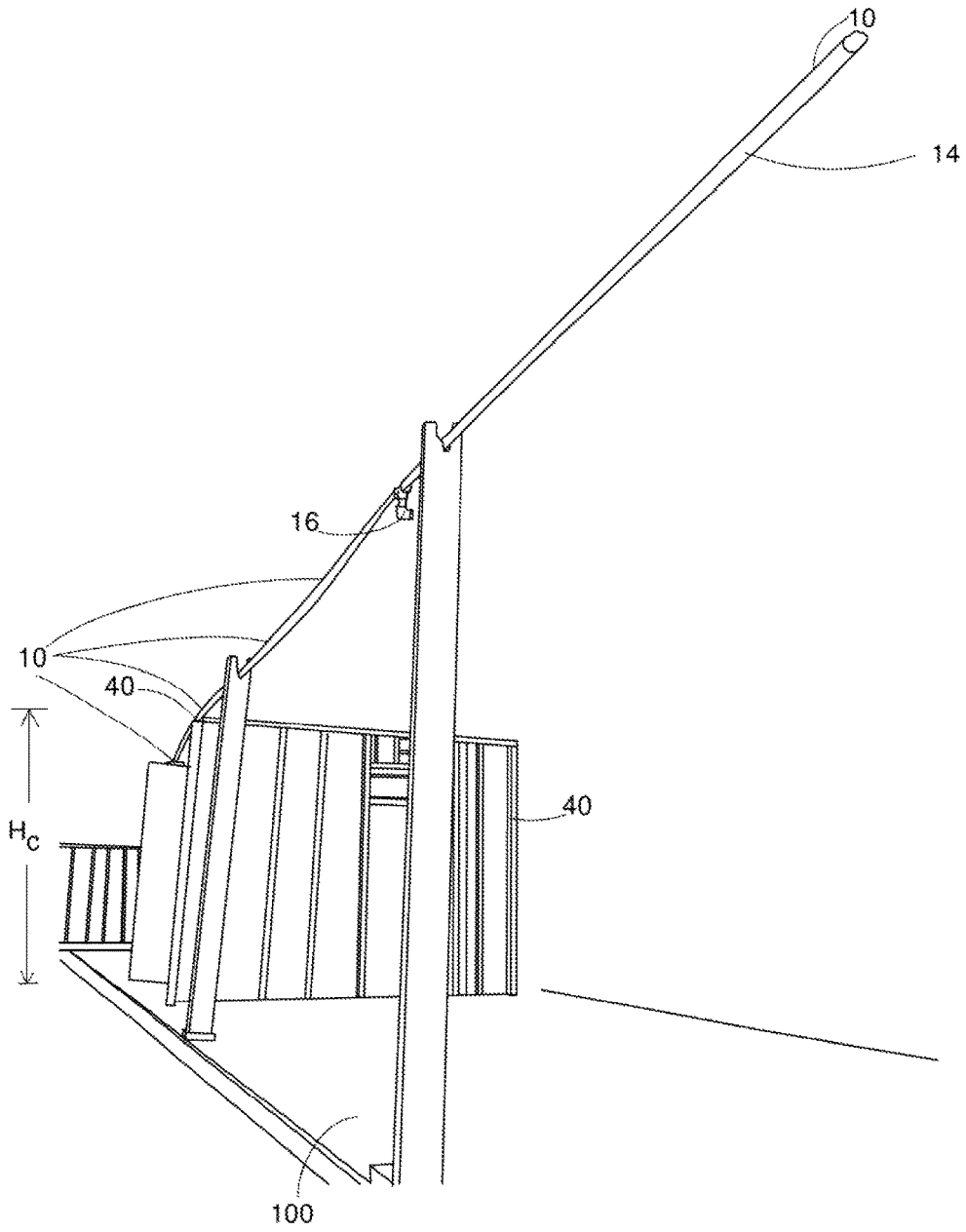
FIG. 8 depicts a perspective view of the exemplary preassembled fire prevention pipe structure of the present invention shown in FIG. 1 positioned on walls of a manufactured home during construction of the manufactured home.
Figure 12:
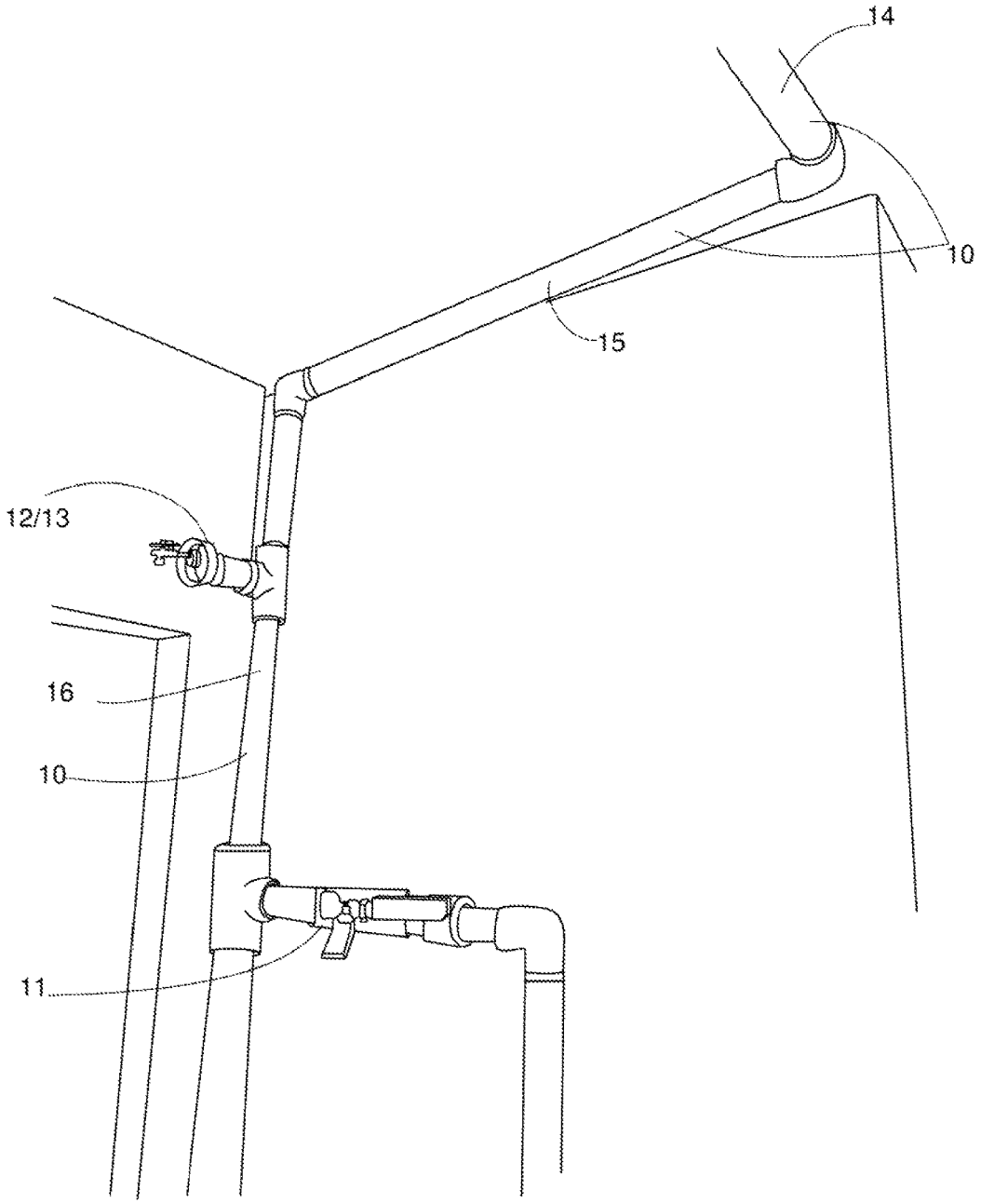
FIG. 12 depicts a perspective view of a portion of the exemplary preassembled fire prevention pipe structure of the present invention shown in FIG. 1 positioned along a wall of a manufactured home during construction of the manufactured home and connected to a water source.
Figure 13:
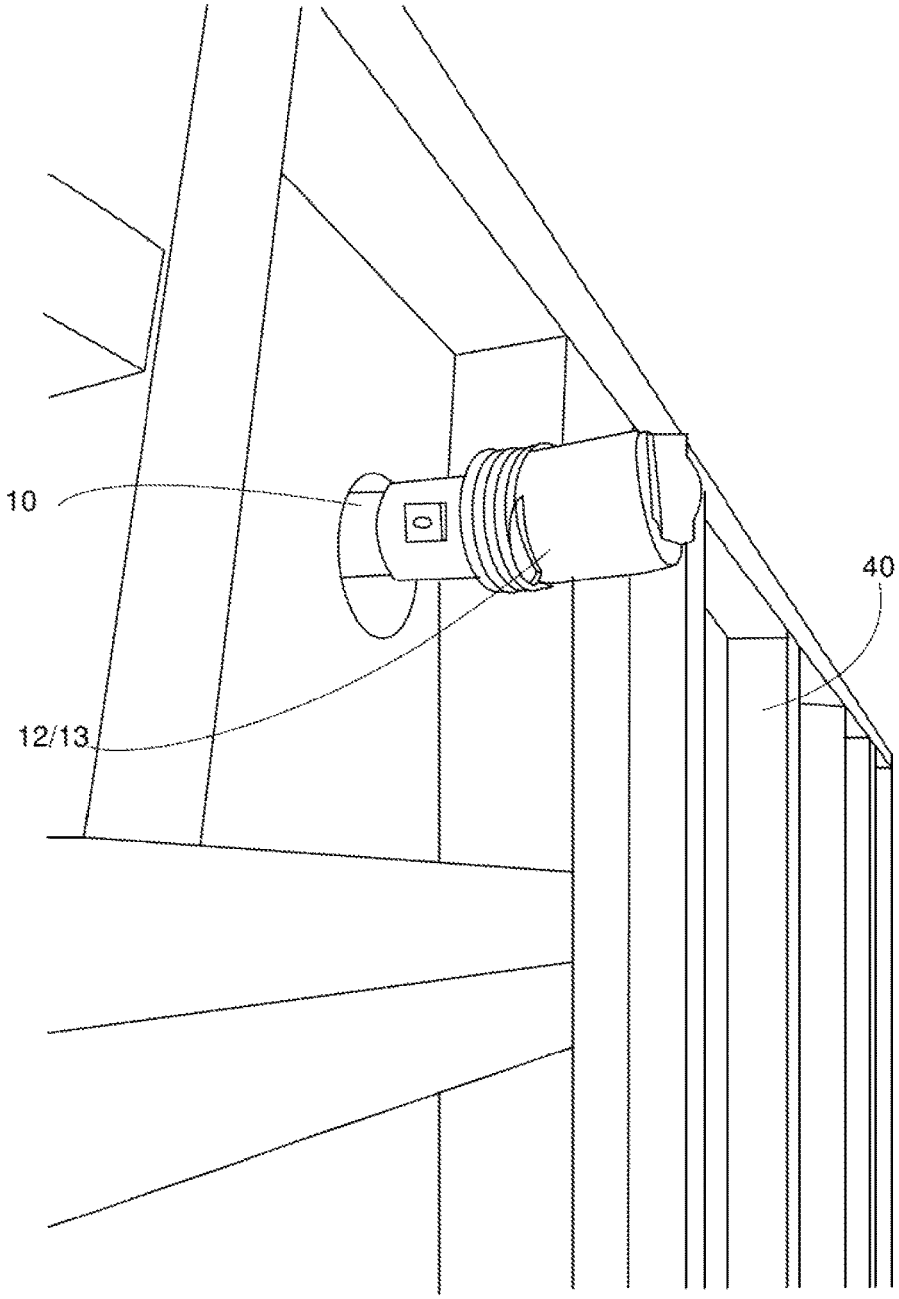
FIG. 13 depicts a view of an exemplary sprinkler head of the exemplary preassembled fire prevention pipe structure of the present invention shown in FIG. 1 positioned within a wall of a manufactured home during construction of the manufactured home.
Figure 14:
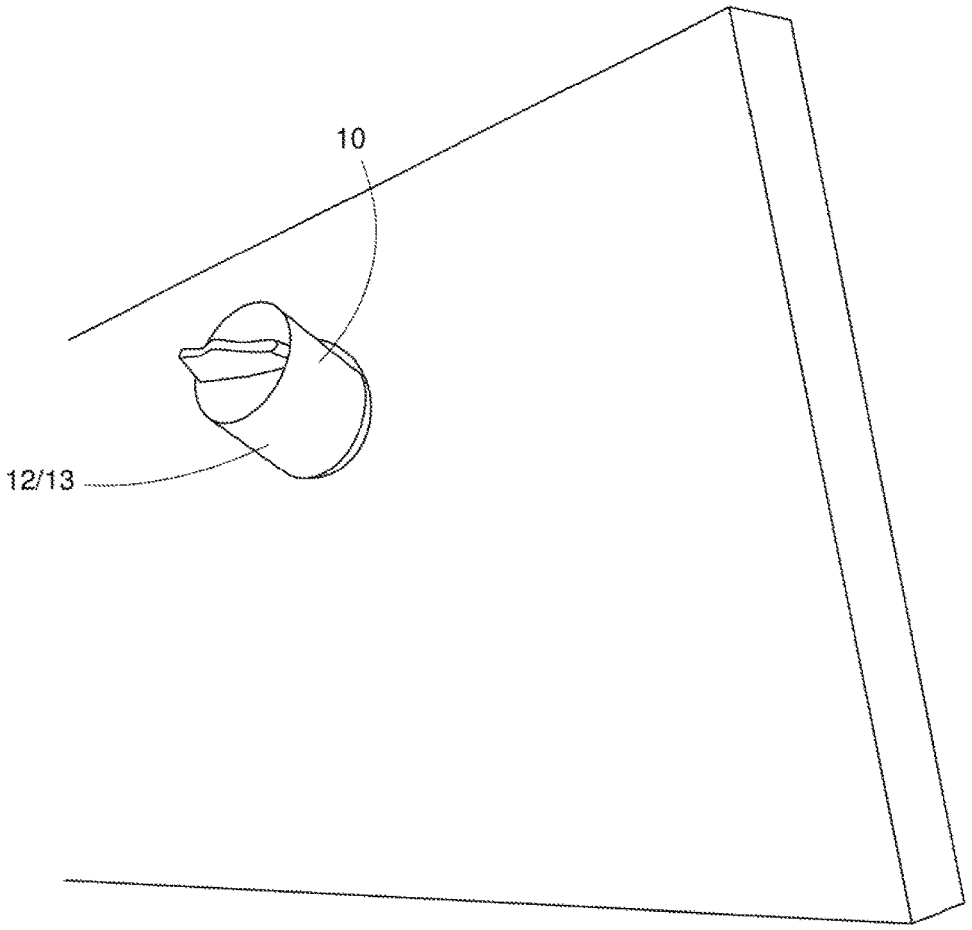
FIG. 14 depicts a view of the exemplary sprinkler head shown in FIG. 13 after an interior wall covering is positioned around the exemplary sprinkler head during construction of a manufactured home.
Figure 15:
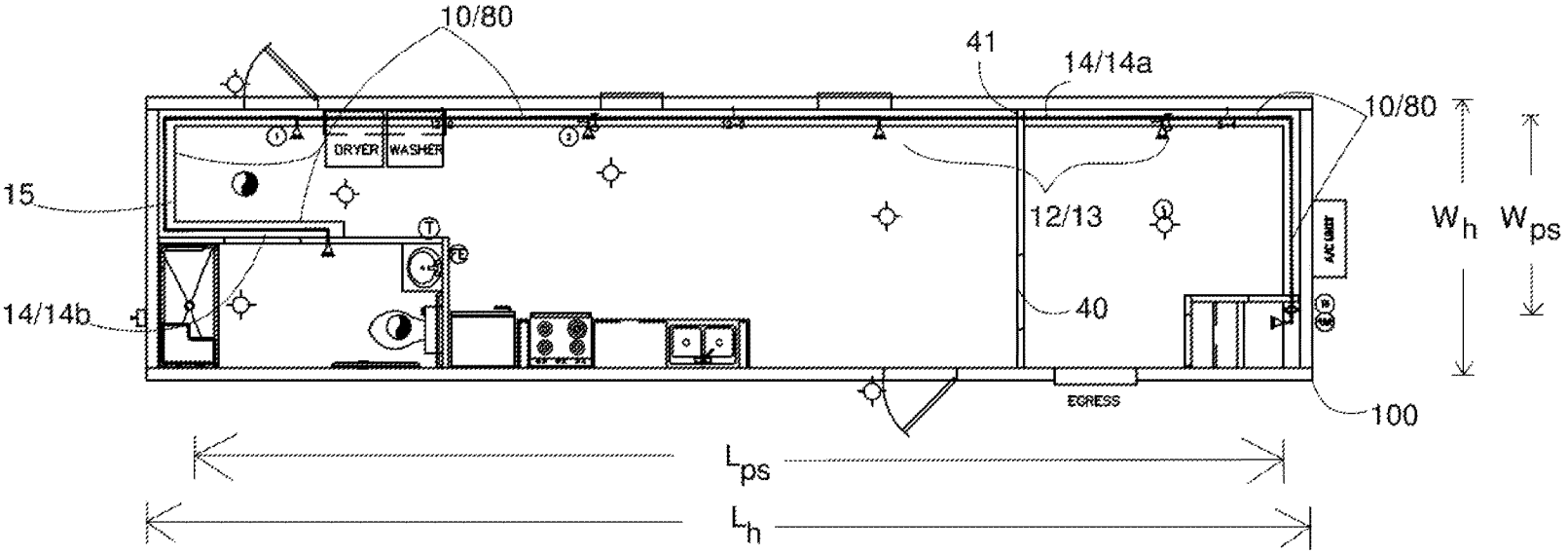
FIG. 15 depicts a floorplan of an exemplary one bedroom manufactured home of the present invention showing the location of an exemplary preassembled fire prevention pipe structure of the present invention within the manufactured home.
Figure 16:
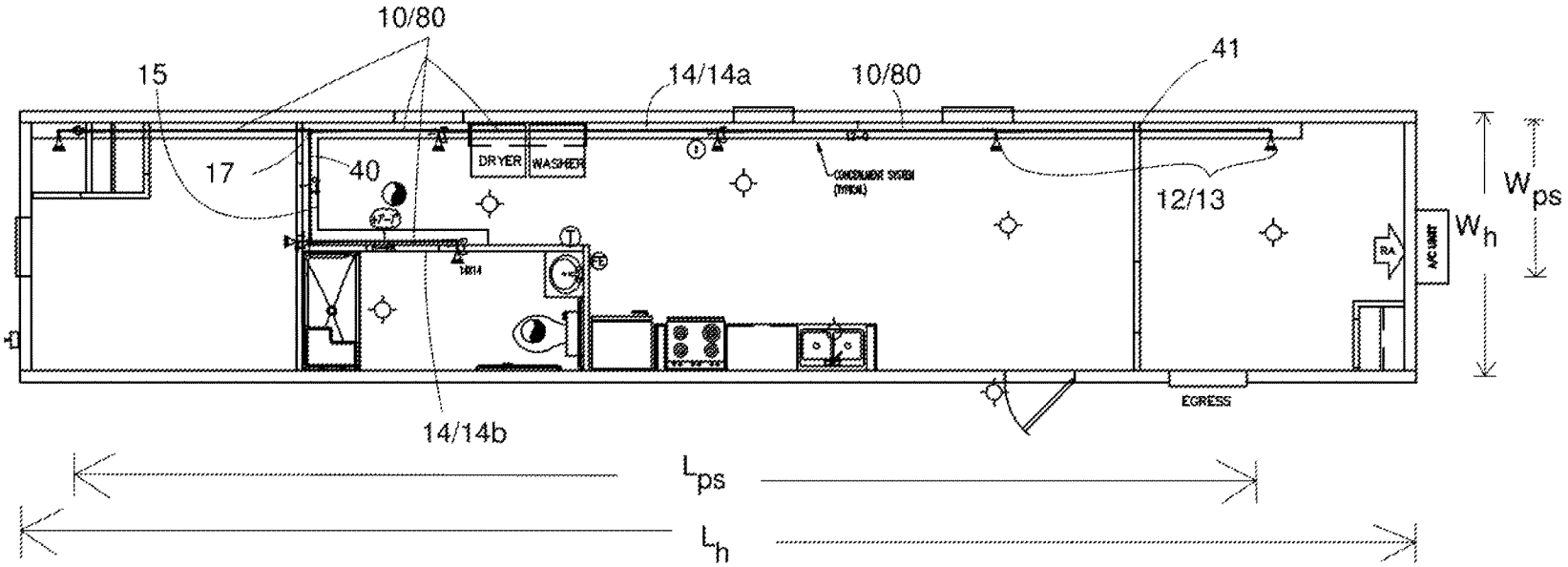
FIG. 16 depicts a floorplan of an exemplary two bedroom manufactured home of the present invention showing the location of an exemplary preassembled fire prevention pipe structure of the present invention within the manufactured home.
Figure 17:
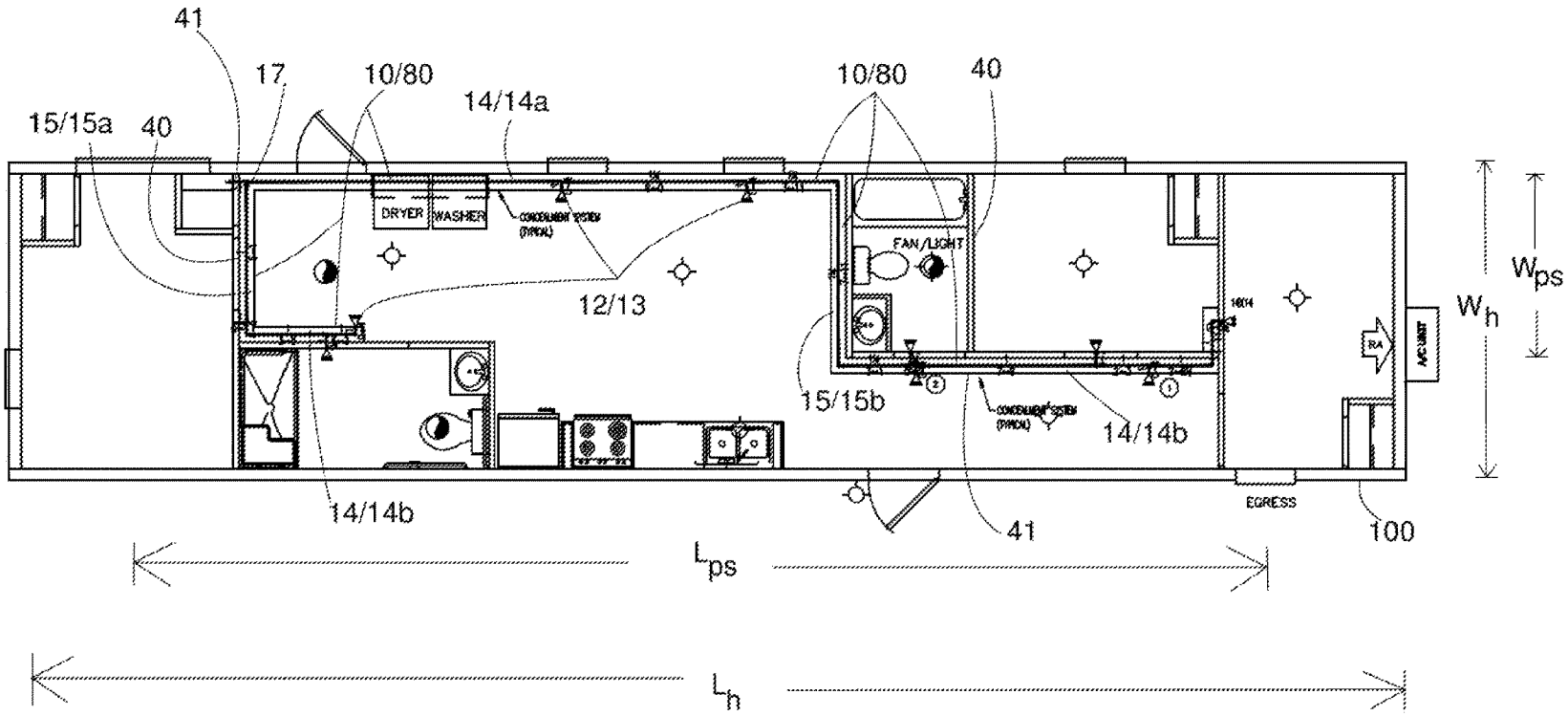
FIG. 17 depicts a floorplan of an exemplary three bedroom manufactured home of the present invention showing the location of an exemplary preassembled fire prevention pipe structure of the present invention within the manufactured home.

1. A method of making a manufactured housing component 10 for a manufactured home 100, said method comprising: forming a preassembled fire prevention pipe structure 10 having an overall pipe structure length $L_{ps}$, an overall pipe structure width $W_{ps}$, and an overall pipe structure height $H_{ps}$, the overall pipe structure length $L_{ps}$ being at least 50% (or any percent between 50% and 100%, in increments of 1.0%, e.g., about 95%, or any range of percentages between 50% and 100%, in increments of 1.0%, e.g., from about 65% to about 96%) of an overall home length $L_h$ of the manufactured home 100, wherein the preassembled fire prevention pipe structure 10 is insertable into a manufactured home 100, as a single piece, so as to provide a fire prevention pipe structure 80 for the manufactured home 100. See, for example, FIGS. 1 and 15-17.
2. A method of making a manufactured home 100, said method comprising: forming a preassembled fire prevention pipe structure 10 having an overall pipe structure length $L_{ps}$, an overall pipe structure width $W_{ps}$, and an overall pipe structure height $H_{ps}$, the overall pipe structure length $L_{ps}$ being at least 50% (or any percent between 50% and 100%, in increments of 1.0%, e.g., about 95%, or any range of percentages between 50% and 100%, in increments of 1.0%, e.g., from about 65% to about 96%) of an overall home length $L_h$ of the manufactured home 100; and after said forming step, incorporating the preassembled fire prevention pipe structure 10 into the manufactured home 100, as a single piece, so as to provide a fire prevention pipe structure 80 for the manufactured home 100. See, for example, FIGS. 15-17.
3. The method of embodiment 1 or 2, wherein the overall pipe structure length $L_{ps}$ is at least 75% of the overall home length $L_h$ of the manufactured home 100.
4. The method of any one of embodiments 1 to 3, wherein the overall pipe structure length $L_{ps}$ is from about 80% to about 99% of the overall home length $L_h$ of the manufactured home 100.
5. The method of any one of embodiments 1 to 4, wherein the overall pipe structure width $W_{ps}$ is at least 30% (or any percent between 30% and 100%, in increments of 1.0%, e.g., about 42%, or any range of percentages between 30% and 100%, in increments of 1.0%, e.g., from about 35% to about 96%) of an overall home width $W_h$ of the manufactured home 100. See, for example, FIGS. 1 and 15-17.
6. The method of any one of embodiments 1 to 5, wherein the overall pipe structure width $W_{ps}$ is from about 40% to about 99% of the overall home width $W_h$ of the manufactured home 100.
7. The method of any one of embodiments 1 to 6, wherein the overall pipe structure height $H_{ps}$ is at least 50% (or any percent between 50% and 100%, in increments of 1.0%, e.g., about 95%, or any range of percentages between 50% and 100%, in increments of 1.0%, e.g., from about 65% to about 96%) of an overall ceiling height $H_c$ of the manufactured home 100. See, for example, FIGS. 1-2 and 8.
8. The method of any one of embodiments 1 to 7, wherein the overall pipe structure height $H_{ps}$ is from about 60% to about 99% of the overall ceiling height $H_c$ of the manufactured home 100.
9. The method of any one of embodiments 1 to 8, wherein the preassembled fire prevention pipe structure 10 comprises a pipe structure inlet 11 and two or more pipe structure outlets 12 in fluid communication with the pipe structure inlet 11. See, for example, FIGS. 1-2 and 12.
10. The method of any one of embodiments 1 to 9, wherein the preassembled fire prevention pipe structure 10 comprises a pipe structure inlet 11, two or more pipe structure outlets 12 in fluid communication with the pipe structure inlet 11, and two or more sprinkler heads 13 located at the two or more pipe structure outlets 12. See, for example, FIGS. 1-2 and 12.
11. The method of any one of embodiments 1 to 10, wherein the preassembled fire prevention pipe structure 10 comprises (i) at least one first pipe 14 extending along the overall pipe structure length $L_{ps}$ connected to (ii) at least one second pipe 15 extending along the overall pipe structure width $W_{ps}$. See, for example, FIGS. 1-3 and 15-17.

Figure 5:
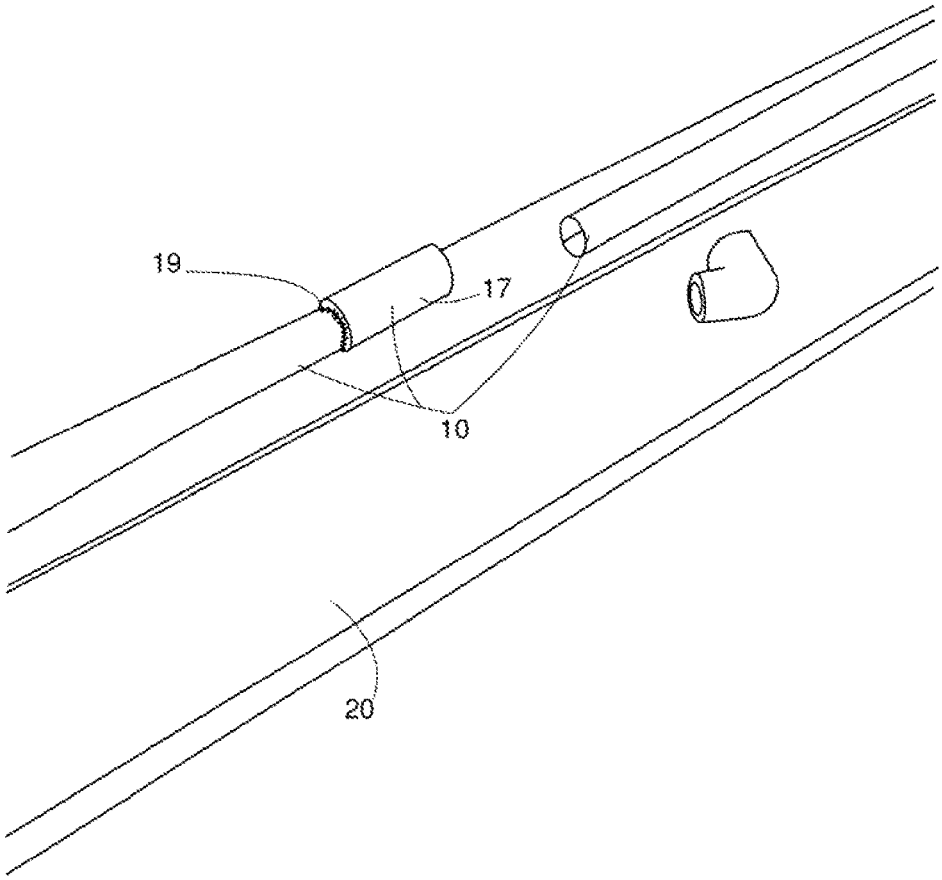
FIG. 5 depicts a perspective view of an exemplary first frame used to form the exemplary preassembled fire prevention pipe structure of the present invention shown in FIG. 1.
Figure 6:
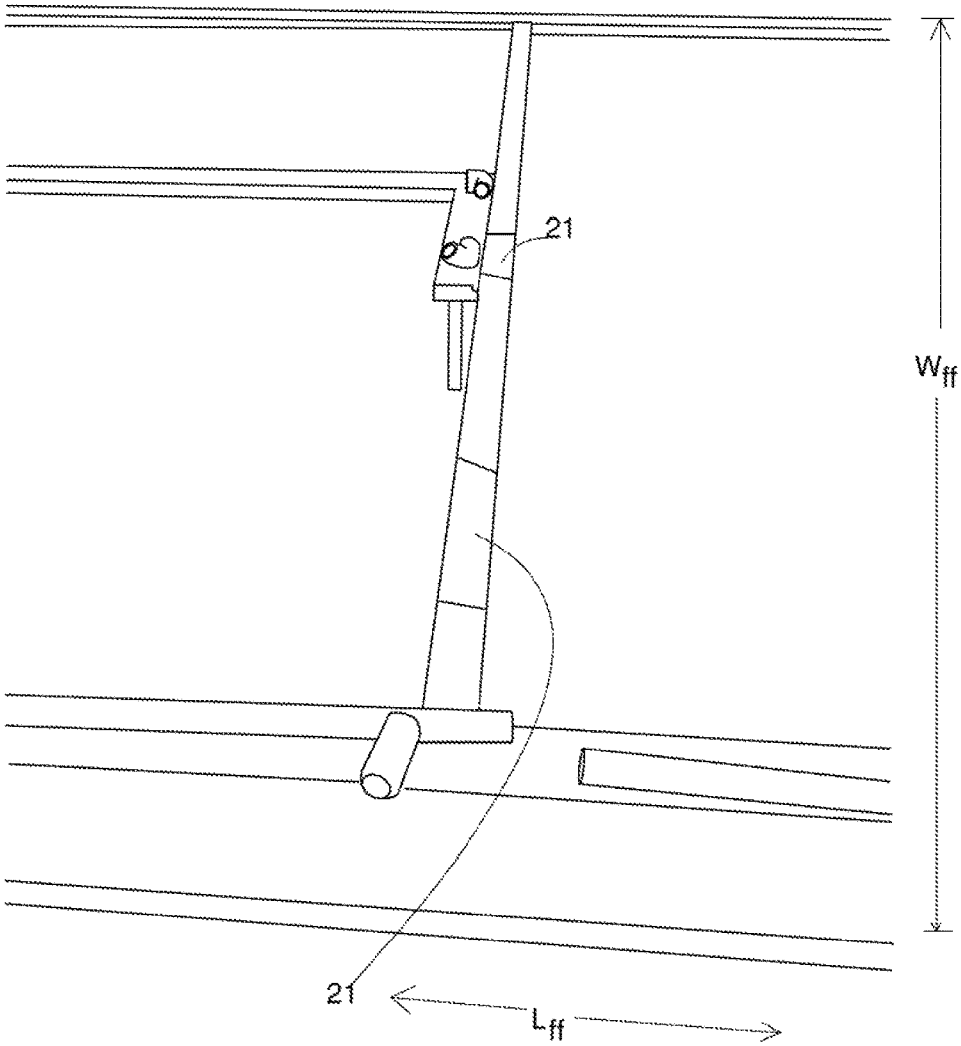
FIG. 6 depicts a perspective view of a portion of the exemplary first frame shown in FIG. 5.
Figure 7:
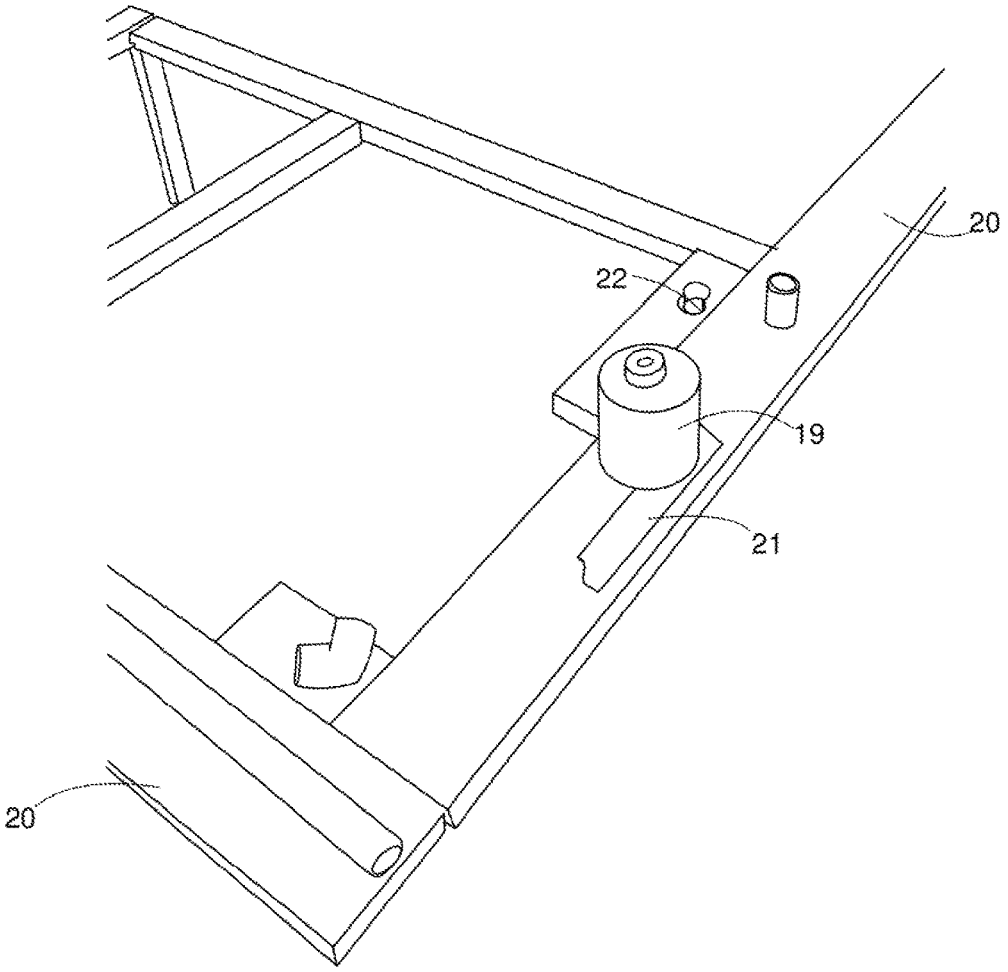
FIG. 7 depicts a perspective view of another portion of the exemplary first frame shown in FIG. 5.
Figure 9:
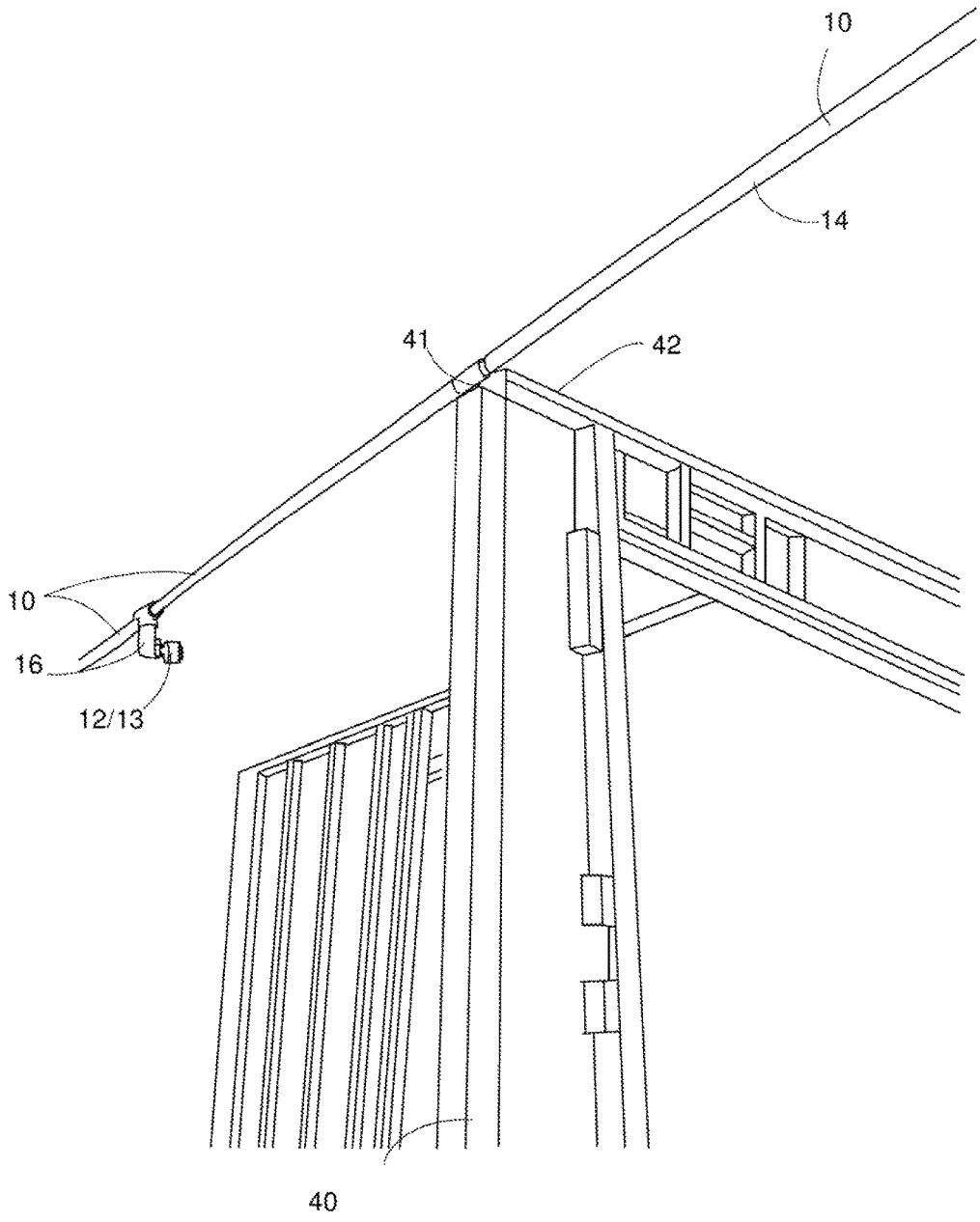
FIG. 9 depicts a perspective view of the exemplary preassembled fire prevention pipe structure of the present invention shown in FIG. 1 positioned within a wall notch of a wall of a manufactured home during construction of the manufactured home.
Figure 10:
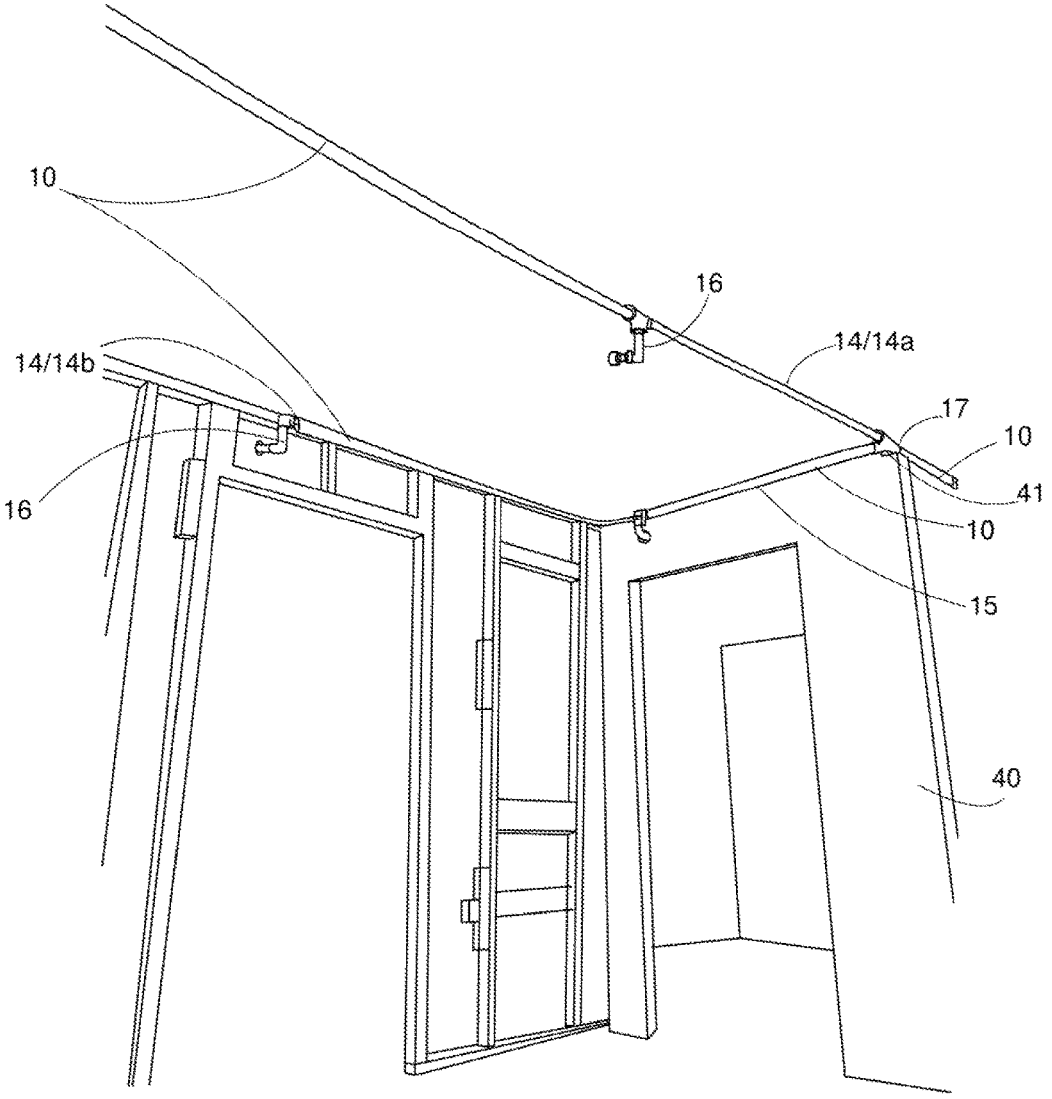
FIG. 10 depicts another perspective view of the exemplary preassembled fire prevention pipe structure of the present invention shown in FIG. 1 positioned within a wall notch of a wall of a manufactured home during construction of the manufactured home.
Figure 11:
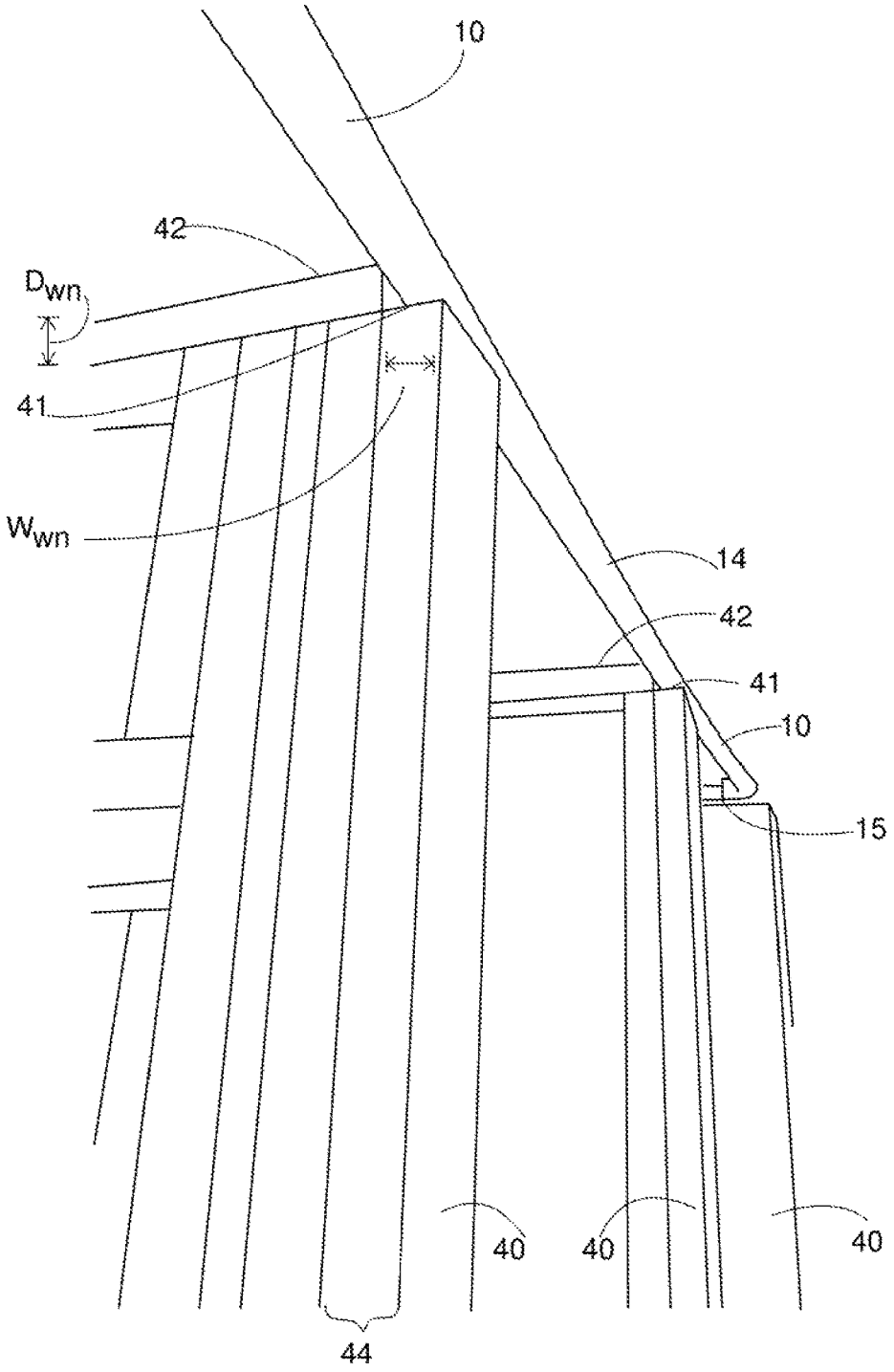
FIG. 11 depicts a perspective view of the exemplary preassembled fire prevention pipe structure of the present invention shown in FIG. 1 positioned within multiple aligned wall notches of multiple parallel walls of a manufactured home during construction of the manufactured home.

12. The method of embodiment 11, wherein the at least one first pipe 14 extending along the overall pipe structure length $L_{ps}$ comprises at least two separate first pipe segments 14*a*/14*b* extending along the overall pipe structure length $L_{ps}$, the at least two separate first pipe segments 14*a*/14*b* being substantially parallel with one another and connected to each other via the at least one second pipe 15 extending along the overall pipe structure width $W_{ps}$. See, for example, FIGS. 1, 4, 10 and 15-17.
13. The method of embodiment 11 or 12, wherein the at least one second pipe 15 extending along the overall pipe structure width $W_{ps}$ comprises at least two separate second pipe segments 15*a*/15*b* extending along the overall pipe structure width $W_{ps}$, the at least two separate second pipe segments 15*a*/15*b* being substantially parallel with one another. See, for example, FIG. 17.
14. The method of any one of embodiments 11 to 13, wherein the preassembled fire prevention pipe structure 10 further comprises (iii) one or more third pipes 16 extending along the overall pipe structure height $H_{ps}$, the one or more third pipes 16 being connected to (a) the at least one first pipe 14, (b) the at least one second pipe 15, or (c) both (a) and (b). See, for example, FIGS. 1-2, 4, 9-10 and 12.
15. The method of embodiment 14, wherein the preassembled fire prevention pipe structure 10 further comprises a sprinkler head 13 positioned along two or more third pipes 16 within the one or more third pipes 16.
16. The method of any one of embodiments 11 to 15, wherein at least one first pipe 14 of the at least one first pipe 14 is connected to at least one second pipe 15 of the at least one second pipe 15 via a T-shaped pipe coupling 17. See, for example, FIGS. 1-3, 5, 10 and 16-17.
17. The method of any one of embodiments 1 to 16, wherein said forming step comprises: assembling multiple pipe segments 14/15 on a first frame structure 20 so as to form the preassembled fire prevention pipe structure 10, the first frame structure 20 having a first frame structure length $L_{ff}$ and a first frame structure width $W_{ff}$, the first frame structure length $L_{ff}$ being equal to or greater than the overall pipe structure length $L_{ps}$, and the first frame structure width $W_{ff}$ being equal to or greater than the overall pipe structure width $W_{ps}$. See, for example, FIGS. 5-7.
18. The method of embodiment 17, wherein the first frame structure 20 comprises one or more markings 21 and/or holes 22, each of which provides guidance to an assembler with regard to positioning of the multiple pipe segments 14/15. See again, for example, FIGS. 5-7.
19. The method of embodiment 18, wherein the first frame structure 20 comprises one or more holes 22 therein, each hole 22 indicating a position of a pipe coupling 17/18 along the preassembled fire prevention pipe structure 10.
20. The method of embodiment 18 or 19, wherein the first frame structure 20 comprises one or more markings 21 thereon, each making 21 indicating a type of pipe segment 14/15 used to form the preassembled fire prevention pipe structure 10. Markings 21 may be, for example, a number and/or letter that indicates a particular pipe segment 14/15, e.g., A=a 10 ft piece of first pipe 14, B=a 3.5 ft piece of first pipe 14, C=a 5.4 ft piece of second pipe 15, D=a T-coupling 17, etc.
21. The method of embodiment 20, wherein the type of pipe segment 14/15/17 comprises (i) a length of pipe 14/15, (ii) a specific pipe coupling (e.g., a 90° coupling 18 or a T-coupling 17), or (iii) both (i) and (ii).
22. The method of any one of embodiments 17 to 21, wherein said forming step comprises: building the first frame structure 20.
23. The method of any one of embodiments 17 to 22, wherein said forming step further comprises: supporting the preassembled fire prevention pipe structure 10 on a second frame structure 30; and connecting one or more pipe segments 16 extending along the overall pipe structure height $H_{ps}$ to the preassembled fire prevention pipe structure 10. See, for example, FIGS. 1-4.
24. The method of embodiment 23, wherein the second frame structure 30 comprises multiple stands 31 spaced from one another, each stand 31 of the multiple stands 31 has (i) a stand height $H_s$ of up to about 8 feet (ft), and a stand notch 32 within an upper surface 33 of the stand 31. See, for example, FIG. 4.
25. The method of any one of embodiments 1 to 24, wherein said forming step further comprises: attaching two or more sprinkler heads 13 to the preassembled fire prevention pipe structure 10. See, for example, FIGS. 1-2, 4, 9 and 12-17.
26. The method of any one of embodiments 1 to 25, wherein said forming step further comprises: pressurizing the preassembled fire prevention pipe structure 10 to check for leaks. Such a pressure test may be performed on preassembled fire prevention pipe structure 10 while preassembled fire prevention pipe structure 10 rests on second frame structure 30 as shown in FIGS. 1-4.
27. The method of any one of embodiments 2 to 26, wherein said incorporating step comprises: positioning the preassembled fire prevention pipe structure 10 on one or more walls 40 of the manufactured home 100. See, for example, FIGS. 8-11 and 15-17.
28. The method of embodiment 27, wherein the one or more walls 40 of the manufactured home 100 comprise one or more walls 40 extending in an overall home width $W_h$ of the manufactured home 100. See again, for example, FIGS. 8-11 and 15-17.
29. The method of embodiment 28, wherein said incorporating step comprises: forming a wall notch 41 within an upper surface 42 of one or more walls 40 extending in an overall home width $W_h$ of the manufactured home 100; and positioning the preassembled fire prevention pipe structure 10 on the one or more walls 40 extending in an overall home width $W_h$ of the manufactured home 100 so that at least a portion of the preassembled fire prevention pipe structure 10 extends within each wall notch 41 within the one or more walls 40 extending in an overall home width $W_h$ of the manufactured home 100. See, for example, FIGS. 9-11.
30. The method of embodiment 28 or 29, wherein said incorporating step comprises: forming a wall notch 41 within an upper surface 42 of each of two or more parallel walls 40 extending in an overall home width $W_h$ of the manufactured home 100; and positioning the preassembled fire prevention pipe structure 10 on the two or more parallel walls 40 extending in the overall home width $W_h$ of the manufactured home 100 so that at least a portion of the preassembled fire prevention pipe structure 10 extends within each wall notch 41 within the two or more parallel walls 40 extending in the overall home width $W_h$ of the manufactured home 100. See, for example, FIG. 11.
31. The method of embodiment 29 or 30, wherein each wall notch 41 has a wall notch width $W_{wn}$ extending along the upper surface 42 of the one or more walls 40 extending in an overall home width $W_h$ of the manufactured home 100, and a notch depth $D_{wn}$ extending into the upper surface 42 of the one or more walls 40 extending in an overall home width $W_h$ of the manufactured home 100. See again, for example, FIG. 11.

32. The method of embodiment 31, wherein the wall notch width $W_{wn}$ ranges from about 1.0 inch (in) to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in), and the wall notch depth $D_{wn}$ ranges from about 1.0 in to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in).
33. The method of any one of embodiments 29 to 32, wherein each wall notch 41 is positioned along an outer edge 44 of the upper surface 42 of the one or more walls 40 extending in an overall home width $W_h$ of the manufactured home 100. See again, for example, FIG. 11.
34. The method of any one of embodiments 27 to 33, further comprising: after said positioning step, assembling a roof (not shown) of the manufactured home 100 over the preassembled fire prevention pipe structure 10.
35. The method of any one of embodiments 27 to 34, further comprising: after said positioning step, assembling a ceiling (not shown) of the manufactured home 100 over the preassembled fire prevention pipe structure 10.
36. The method of any one of embodiments 1 to 35, wherein each pipe component 14/15/16 of the preassembled fire prevention pipe structure 10 comprises fire resistant pipe 14/15/16.
37. The method of any one of embodiments 1 to 36, wherein each pipe component 14/15/16 of the preassembled fire prevention pipe structure 10 comprises fire resistant polyvinyl chloride pipe 14/15/16. In some desired embodiments, pipe component 14/15/16 and pipe couplings 17/18 of the preassembled fire prevention pipe structure 10 comprise fire resistant chlorinated polyvinyl chloride (CPVC) pipe 14/15/16 and pipe couplings 17/18. Suitable CPVC pipe and pipe couplings (i.e., fittings) are commercially available as TYCO® CPVC pipe and fittings, which utilize the BLAZEMASTER® CPVC compound (The Lubrizol Corporation, Louisville, Ky.), from Tyco Fire & Building Products (Lansdale, Pa.).
38. The method of any one of embodiments 1 to 37, wherein each pipe component 14/15/16 of the preassembled fire prevention pipe structure 10 is adhered to one another via pipe glue 19. See, for example, FIGS. 5 and 7.
39. The method of any one of embodiments 1 to 38, wherein each pipe component 14/15/16 of the preassembled fire prevention pipe structure 10 is adhered to one another via pipe glue 19, the pipe glue 19 comprising a CPVC resin/glue/cement. In some desired embodiments, pipe glue 19 of the preassembled fire prevention pipe structure 10 comprises a CPVC resin/glue/cement, desirably, a low volatile organic compounds (VOC) CPVC resin/glue/cement. Suitable CPVC resin/glue/cement is commercially available as SPEARS® FLAMEGUARD® FS-5 RED One-Step CPVC resin/glue/cement available from Spears Manufacturing Company (Sylmar, Calif.).

Manufactured Housing Components

40. The preassembled fire prevention pipe structure 10 formed by the method of any one of embodiments 1, 3 to 26 and 36 to 39.
42. A preassembled fire prevention pipe structure 10 for a manufactured home 100, said preassembled fire prevention pipe structure 10 comprising: multiple pipe segments 14/15/16 and multiple pipe couplings 17/18 connected to one another so as to have an overall pipe structure length $L_{ps}$, an overall pipe structure width $W_{ps}$, and an overall pipe structure height $H_{ps}$, the overall pipe structure length $L_{ps}$ being at least 50% (or any percent between 50% and 100%, in increments of 1.0%, e.g., about 95%, or any range of percentages between 50% and 100%, in increments of 1.0%, e.g., from about 65% to about 96%) of an overall home length $L_h$ of the manufactured home 100, wherein the preassembled fire prevention pipe structure 10 is insertable into a manufactured home 100, as a single piece, so as to provide a fire prevention pipe structure 80 for the manufactured home 100.
43. The preassembled fire prevention pipe structure 10 of embodiment 42, wherein the overall pipe structure length $L_{ps}$ is at least 75% of the overall home length $L_h$ of the manufactured home 100.
44. The preassembled fire prevention pipe structure 10 of embodiment 42 or 43, wherein the overall pipe structure length $L_{ps}$ is from about 80% to about 99% of the overall home length $L_h$ of the manufactured home 100.
45. The preassembled fire prevention pipe structure 10 of any one of embodiments 42 to 44, wherein the overall pipe structure width $W_{ps}$ is at least 30% (or any percent between 30% and 100%, in increments of 1.0%, e.g., about 42%, or any range of percentages between 30% and 100%, in increments of 1.0%, e.g., from about 35% to about 96%) of an overall home width $W_h$ of the manufactured home 100.
46. The preassembled fire prevention pipe structure 10 of any one of embodiments 42 to 45, wherein the overall pipe structure width $W_{ps}$ is from about 40% to about 99% of the overall home width $W_h$ of the manufactured home 100.
47. The preassembled fire prevention pipe structure 10 of any one of embodiments 42 to 46, wherein the overall pipe structure height $H_{ps}$ is at least 50% (or any percent between 50% and 100%, in increments of 1.0%, e.g., about 95%, or any range of percentages between 50% and 100%, in increments of 1.0%, e.g., from about 65% to about 96%) of an overall ceiling height $H_c$ of the manufactured home 100.
48. The preassembled fire prevention pipe structure 10 of any one of embodiments 42 to 47, wherein the overall pipe structure height $H_{ps}$ is from about 60% to about 99% of the overall ceiling height $H_c$ of the manufactured home 100.
49. The preassembled fire prevention pipe structure 10 of any one of embodiments 42 to 48, wherein the preassembled fire prevention pipe structure 10 comprises a pipe structure inlet 11 and two or more pipe structure outlets 12 in fluid communication with the pipe structure inlet 11.
50. The preassembled fire prevention pipe structure 10 of any one of embodiments 42 to 49, wherein the preassembled fire prevention pipe structure 10 comprises a pipe structure inlet 11, two or more pipe structure outlets 12 in fluid communication with the pipe structure inlet 11, and two or more sprinkler heads 13 located at the two or more pipe structure outlets 12.
51. The preassembled fire prevention pipe structure 10 of any one of embodiments 42 to 50, wherein the preassembled fire prevention pipe structure 10 comprises (i) at least one first pipe 14 extending along the overall pipe structure length $L_{ps}$ connected to (ii) at least one second pipe 15 extending along the overall pipe structure width $W_{ps}$.

52. The preassembled fire prevention pipe structure 10 of embodiment 51, wherein the at least one first pipe 14 extending along the overall pipe structure length $L_{ps}$ comprises at least two separate first pipe segments 14*a*/14*b* extending along the overall pipe structure length $L_{ps}$, the at least two separate first pipe segments 14*a*/14*b* being substantially parallel with one another and connected to each other via the at least one second pipe 15 extending along the overall pipe structure width $W_{ps}$.

53. The preassembled fire prevention pipe structure 10 of embodiment 51 or 52, wherein the at least one second pipe 15 extending along the overall pipe structure width $W_{ps}$ comprises at least two separate second pipe segments 15*a*/15*b* extending along the overall pipe structure width $W_{ps}$, the at least two separate second pipe segments 15*a*/15*b* being substantially parallel with one another.

54. The preassembled fire prevention pipe structure 10 of any one of embodiments 51 to 53, wherein the preassembled fire prevention pipe structure 10 further comprises (iii) one or more third pipes 16 extending along the overall pipe structure height $H_{ps}$, the one or more third pipes 16 being connected to (a) the at least one first pipe 14, (b) the at least one second pipe 15, or (c) both (a) and (b).

55. The preassembled fire prevention pipe structure 10 of embodiment 54, wherein the preassembled fire prevention pipe structure 10 further comprises a sprinkler head 13 positioned along two or more third pipes 16 within the one or more third pipes 16.

56. The preassembled fire prevention pipe structure 10 of any one of embodiments 51 to 55, wherein at least one first pipe 14 of the at least one first pipe 14 is connected to at least one second pipe 15 of the at least one second pipe 15 via a T-shaped pipe coupling 17.

57. The preassembled fire prevention pipe structure 10 of any one of embodiments 42 to 56, wherein said preassembled fire prevention pipe structure 10 is positioned on a first frame structure 20 used to form the preassembled fire prevention pipe structure 10, the first frame structure 20 having a first frame structure length $L_{ff}$ and a first frame structure width $W_{ff}$, the first frame structure length $L_{ff}$ being equal to or greater than the overall pipe structure length $L_{ps}$, and the first frame structure width $W_{ff}$ being equal to or greater than the overall pipe structure width $W_{ps}$.

58. The preassembled fire prevention pipe structure 10 of embodiment 57, wherein the first frame structure 20 comprises one or more markings 21 and/or holes 22, each of which provides guidance to an assembler with regard to positioning of the multiple pipe segments 14/15/17/18.

59. The preassembled fire prevention pipe structure 10 of embodiment 58, wherein the first frame structure 20 comprises one or more holes 22 therein, each hole 22 indicating a position of a pipe coupling 17/18 along the preassembled fire prevention pipe structure 10.

60. The preassembled fire prevention pipe structure 10 of embodiment 58 or 59, wherein the first frame structure 20 comprises one or more markings 21 thereon, each making 21 indicating a type of pipe segment 14/15/17/18 used to form the preassembled fire prevention pipe structure 10.

61. The preassembled fire prevention pipe structure 10 of embodiment 60, wherein the type of pipe segment 14/15/17/18 comprises (i) a length of pipe 14/15, (ii) a specific pipe coupling (e.g., a 90° coupling 18 or a T-coupling 17), or (iii) both (i) and (ii).

62. The preassembled fire prevention pipe structure 10 of any one of embodiments 42 to 56, wherein said preassembled fire prevention pipe structure 10 is positioned on a second frame structure 30, the second frame structure 30 comprising multiple stands 31 spaced from one another, each stand 31 of the multiple stands 31 has (i) a stand height $H_s$ of up to about 8 feet (ft), and a stand notch 32 within an upper surface 33 of the stand 31.

63. The preassembled fire prevention pipe structure 10 of any one of embodiments 42 to 56, wherein said preassembled fire prevention pipe structure 10 is positioned on one or more walls 40 of the manufactured home 100.

64. The preassembled fire prevention pipe structure 10 of embodiment 63, wherein the one or more walls 40 of the manufactured home 100 comprise one or more walls 40 extending in an overall home width $W_h$ of the manufactured home 100.

65. The preassembled fire prevention pipe structure 10 of embodiment 63 or 64, wherein said preassembled fire prevention pipe structure 10 is positioned within one or more wall notches 41 within an upper surface 42 of one or more walls 40 extending in an overall home width $W_h$ of the manufactured home 100.

66. The preassembled fire prevention pipe structure 10 of any one of embodiments 63 to 65, wherein said preassembled fire prevention pipe structure 10 is positioned within two or more wall notches 41 within an upper surface 42 of each of two or more parallel walls 40 of the manufactured home 100.

67. The preassembled fire prevention pipe structure 10 of any one of embodiments 63 to 66, wherein each wall notch 41 has a wall notch width $W_{wn}$ extending along the upper surface 42 of the one or more walls 40 extending in an overall home width $W_h$ of the manufactured home 100, and a notch depth $D_{wn}$ extending into the upper surface 42 of the one or more walls 40 extending in an overall home width $W_h$ of the manufactured home 100.

68. The preassembled fire prevention pipe structure 10 embodiment 67, wherein the wall notch width $W_{wn}$ ranges from about 1.0 inch (in) to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in), and the wall notch depth $D_{wn}$ ranges from about 1.0 in to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in).

69. The preassembled fire prevention pipe structure 10 of any one of embodiments 65 to 68, wherein each wall notch 41 is positioned along an outer edge 43 of the upper surface 42 of the one or more walls 40 extending in an overall home width $W_h$ of the manufactured home 100.

70. The preassembled fire prevention pipe structure 10 of any one of embodiments 42 to 69, wherein each of the multiple pipe segments 14/15/16 and multiple pipe couplings 17/18 of the preassembled fire prevention pipe structure 10 comprises fire resistant pipe segments 14/15/16 and fire resistant pipe couplings 17/18.

71. The preassembled fire prevention pipe structure 10 of any one of embodiments 42 to 70, wherein each of the multiple pipe segments 14/15/16 and multiple pipe couplings 17/18 of the preassembled fire prevention pipe structure 10 comprises fire resistant polyvinyl chloride pipe segments 14/15/16 and fire resistant polyvinyl chloride pipe couplings 17/18. As discussed above, in some desired embodiments, pipe component 14/15/16 and pipe couplings 17/18 of the preassembled fire prevention pipe structure 10 comprise fire resistant chlorinated polyvinyl chloride (CPVC) pipe 14/15/16 and pipe couplings 17/18. Suitable CPVC pipe and pipe couplings (i.e., fittings) are commercially available as TYCO® CPVC pipe and fittings, which utilize the BLAZEMASTER® CPVC compound (The Lubrizol Corporation, Louisville, Ky.), from Tyco Fire & Building Products (Lansdale, Pa.).

72. The preassembled fire prevention pipe structure 10 of any one of embodiments 42 to 71, wherein each of the multiple pipe segments 14/15/16 and multiple pipe couplings 17/18 of the preassembled fire prevention pipe structure 10 is adhered to one another via pipe glue 19.

73. The preassembled fire prevention pipe structure of any one of embodiments 42 to 72, wherein each of the multiple pipe segments 14/15/16 and multiple pipe couplings 17/18 of the preassembled fire prevention pipe structure 10 is adhered to one another via pipe glue 19, the pipe glue 19 comprising a CPVC resin/glue/cement. As discussed above, suitable CPVC resin/glue/cement is commercially available as SPEARS® FLAMEGUARD® FS-5 RED One-Step CPVC resin/glue/cement available from Spears Manufacturing Company (Sylmar, Calif.).

Manufactured Homes

The manufactured home 100 formed by the method of any one of embodiments 2 to 39.

74. A manufactured home 100 comprising the preassembled fire prevention pipe structure 10 of any one of embodiments 42 to 73.

75. A manufactured home 100 having an overall home length $L_h$ and an overall home width $W_h$, said manufactured home 100 comprising: one or more walls 40 extending in the overall home width $W_h$, at least one of said one or more walls 40 extending in the overall home width $W_h$ comprising a wall notch 41 within an upper surface 42 of the one or more walls 40 extending in an overall home width $W_h$ of the manufactured home 100.

76. The manufactured home 100 of embodiment 75, wherein said one or more walls 40 extending in the overall home width $W_h$ comprises two or more parallel walls 40 extending in the overall home width $W_h$, and at least two walls 40 within said two or more parallel walls 40 extending in the overall home width $W_h$ each comprises a wall notch 41 within the upper surface 42 of the at least two walls 40 within said two or more parallel walls 40 extending in the overall home width $W_h$.

77. The manufactured home 100 of embodiment 75 or 76, wherein each wall notch 41 has a wall notch width $W_{wn}$ extending along the upper surface 42 of the one or more walls 40 extending in an overall home width $W_h$ of the manufactured home 100, and a notch depth $D_{wn}$ extending into the upper surface 42 of the one or more walls 40 extending in an overall home width $W_h$ of the manufactured home 100.

78. The manufactured home 100 of embodiment 77, wherein the wall notch width $W_{wn}$ ranges from about 1.0 inch (in) to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in), and the wall notch depth $D_{wn}$ ranges from about 1.0 in to about 5.0 in (or any value between 1.0 in and 5.0 in, in increments of 0.1 in, e.g., about 3.0 in, or any range of values between 1.0 in and 5.0 in, in increments of 0.1 in, e.g., from about 2.8 in to about 3.2 in).

79. The manufactured home 100 of any one of embodiments 75 to 78, wherein each wall notch 41 is positioned along an outer edge 43 of the upper surface 42 of the one or more walls 40 extending in an overall home width $W_h$ of the manufactured home 100.

80. The manufactured home 100 of any one of embodiments 75 to 79, further comprising: the preassembled fire prevention pipe structure 10 formed by the method of any one of embodiments 1, 3 to 26 and 36 to 39 or the preassembled fire prevention pipe structure 10 of any one of embodiments 40 and 42 to 73 positioned on the one or more walls 40 extending in the overall home width $W_h$.

81. The manufactured home 100 of embodiment 80, wherein the manufactured home 100 does not comprise a roof (not shown) or ceiling (not shown) over the preassembled fire prevention pipe structure 10.

82. The manufactured home 100 of embodiment 80, wherein the manufactured home 100 further comprises a roof (not shown), a ceiling (not shown), or both a roof (not shown) and a ceiling (not shown) over the preassembled fire prevention pipe structure 10.

It should be understood that although the above-described methods, manufactured housing components and manufactured homes are described as "comprising" one or more components or steps, the above-described methods, manufactured housing components and manufactured homes may "comprise," "consists of" or "consist essentially of" any of the above-described components or steps of the methods, manufactured housing components and manufactured homes. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a method, manufactured housing component or manufactured home that "comprises" a list of elements (e.g., components or steps) is not necessarily limited to only those elements (or components or steps), but may include other elements (or components or steps) not expressly listed or inherent to the method, manufactured housing component or manufactured home.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a method, manufactured housing component or manufactured home that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described methods, manufactured housing components and manufactured homes may comprise, consist essentially of, or consist of any of the herein-described components and features, as shown in the figures with or without any feature(s) not shown in the figures. In other words, in some embodiments, the methods, manufactured housing components and manufactured homes of the present invention do not have any additional features other than those shown in the figures, and such additional features, not shown in the figures, are specifically excluded from the methods, manufactured housing components and manufactured homes. In other embodiments, the methods, manufactured housing components and manufactured homes of the present invention do have one or more additional features that are not shown in the figures.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Methods, manufactured housing components and manufactured homes, as described in embodiments 1 to 82, and as shown in FIGS. 1-17, were prepared.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A method of making a manufactured housing component for a manufactured home, said method comprising:

forming a preassembled fire prevention pipe structure having an overall pipe structure length, an overall pipe structure width, and an overall pipe structure height, the overall pipe structure length being at least 50% of an overall home length of the manufactured home and the overall pipe structure width being at least 30% of an overall home width of the manufactured home;

after said forming step, positioning the preassembled fire prevention pipe structure into the manufactured home, as a single piece, so as to provide a fire prevention pipe structure for the manufactured home, the fire prevention pipe structure providing fluid flow for a fluid within the fire prevention pipe structure in (i) a first direction along the overall pipe structure length and (ii) a second direction along the overall pipe structure width; and after said positioning step, assembling a roof of the manufactured home over the preassembled fire prevention pipe structure.

2. The method of claim 1, wherein the overall pipe structure length is at least 75% of the overall home length of the manufactured home, and the overall pipe structure height is at least 50% of an overall ceiling height of the manufactured home.

3. The method of claim 1, wherein the preassembled fire prevention pipe structure comprises a pipe structure inlet, two or more pipe structure outlets in fluid communication with the pipe structure inlet, and two or more sprinkler heads located at the two or more pipe structure outlets.

4. The method of claim 1, wherein said forming step further comprises:

pressurizing the preassembled fire prevention pipe structure to check for leaks.

5. The method of claim 1, wherein said incorporating step comprises:

positioning the preassembled fire prevention pipe structure on one or more walls of the manufactured home, wherein the one or more walls of the manufactured home comprise one or more walls extending in an overall home width of the manufactured home.

6. The method of claim 1, wherein said incorporating step comprises:

forming a wall notch within an upper surface of one or more walls extending in an overall home width of the manufactured home; and positioning the preassembled fire prevention pipe structure on the one or more walls extending in an overall home width of the manufactured home so that at least a portion of the preassembled fire prevention pipe structure extends within the wall notch within the one or more walls extending in an overall home width of the manufactured home.

7. The method of claim 6, wherein each wall notch has a wall notch width that ranges from about 1.0 inch (in) to about 5.0 in, and a wall notch depth that ranges from about 1.0 in to about 5.0 in.

8. The method of claim 6, wherein the wall notch is positioned proximate an outer edge of the upper surface of the one or more walls extending in an overall home width of the manufactured home.

9. The preassembled fire prevention pipe structure formed by the method of claim 1, wherein said preassembled fire prevention pipe structure comprises fire resistant polyvinyl chloride pipe or chlorinated polyvinyl chloride pipe.

10. The method of claim 1, wherein the preassembled fire prevention pipe structure comprises fire resistant polyvinyl chloride pipe or chlorinated polyvinyl chloride pipe.

11. A method making a manufactured housing component for a manufactured home, said method comprising:

forming a preassembled fire prevention pipe structure having an overall pipe structure length, an overall pipe structure width, and an overall pipe structure height, the overall pipe structure length being at least 50% of an overall home length of the manufactured home, wherein said forming step comprises:

assembling multiple pipe segments on a first frame structure so as to form the preassembled fire prevention pipe structure, the first frame structure having a first frame structure length and a first frame structure width, the first frame structure length being equal to or greater than the overall pipe structure length, and the first frame structure width being equal to or greater than the overall pipe structure width; and after said forming step, positioning the preassembled fire prevention pipe structure into the manufactured home, as a single piece, so as to provide a fire prevention pipe structure for the manufactured home; and after said positioning step, assembling a roof of the manufactured home over the preassembled fire prevention pipe structure.

12. The method of claim 11, wherein the first frame structure comprises one or more markings, one or more holes, or both one or more markings and one or more holes, each of which provides guidance to an assembler with regard to positioning of the multiple pipe segments.

13. The method of claim 12, wherein the first frame structure comprises (i) the one or more holes therein, each hole indicating a position of a pipe coupling along the preassembled fire prevention pipe structure, and (ii) the one or more markings thereon, each making indicating a type of pipe segment used to form the preassembled fire prevention pipe structure.

14. The method of claim 11, wherein said forming step further comprises:

supporting the preassembled fire prevention pipe structure on a second frame structure; and connecting one or more pipe segments extending along the overall pipe structure height to the preassembled fire prevention pipe structure, wherein the second frame structure comprises multiple stands spaced from one another, each stand of the multiple stands has (i) a stand height of up to about 8 feet (ft), and a stand notch within an upper surface of the stand.

15. A method of making a manufactured housing component for a manufactured home, said method comprising:

forming one or more wall notches within an upper surface of one or more walls extending in an overall home width of the manufactured home; and positioning one or more portions of a preassembled fire prevention pipe structure within the one or more wall notches, the preassembled fire prevention pipe structure (a) having an overall pipe structure length, an overall pipe structure width, and an overall pipe structure height, the overall pipe structure length being at least 50% of an overall home length of the manufactured home and the overall pipe structure width being at least 30% of an overall home width of the manufactured home so as to provide a fire prevention pipe structure for the manufactured home, the fire prevention pipe structure providing fluid flow for a fluid within the fire prevention pipe structure in (i) a first direction along the overall pipe structure length and (ii) a second direction along the overall pipe structure width, and (b) comprising fire resistant polyvinyl chloride pipe or chlorinated polyvinyl chloride pipe; and after said positioning step, assembling a roof of the manufactured home over the preassembled fire prevention pipe structure.

16. The method of claim 15, further comprising:

forming the preassembled fire prevention pipe structure prior to said positioning step.

17. A method of making a manufactured housing component for a manufactured home, said method comprising:

forming one or more walls extending in an overall home width of the manufactured home; and positioning one or more portions of a preassembled fire prevention pipe structure on an upper surface of the one or more walls extending in an overall home width of the manufactured home, the preassembled fire prevention pipe structure (a) having an overall pipe structure length, an overall pipe structure width, and an overall pipe structure height, the overall pipe structure length being at least 50% of an overall home length of the manufactured home and the overall pipe structure width being at least 30% of an overall home width of the manufactured home so as to provide a fire prevention pipe structure for the manufactured home, the fire prevention pipe structure providing fluid flow for a fluid within the fire prevention pipe structure in a first direction along the overall pipe structure length and a second direction along the overall pipe structure width, and (b) comprising fire resistant polyvinyl chloride pipe or chlorinated polyvinyl chloride pipe; and after said positioning step, assembling a roof of the manufactured home over the preassembled fire prevention pipe structure.

18. The method of claim 17, further comprising:

forming the preassembled fire prevention pipe structure prior to said positioning step.

* * * * *